US009039349B2

(12) United States Patent
Demetri et al.

(10) Patent No.: US 9,039,349 B2
(45) Date of Patent: May 26, 2015

(54) TURBOCOMPRESSOR AND SYSTEM FOR A SUPERCRITICAL-FLUID CYCLE

(75) Inventors: Elia P. Demetri, Westford, MA (US); Oleg Dubitsky, Hanover, NH (US); Louis Larosiliere, Quechee, VT (US); Robert Pelton, Lebanon, NH (US); Karl Wygant, Pearland, TX (US)

(73) Assignee: Concepts ETI, Inc., White River Junction, VT (US)

( * ) Notice: Subject to any disclaimer, the term of this patent is extended or adjusted under 35 U.S.C. 154(b) by 549 days.

(21) Appl. No.: 13/265,505

(22) PCT Filed: Apr. 27, 2010

(86) PCT No.: PCT/US2010/032562

§ 371 (c)(1),
(2), (4) Date: Oct. 20, 2011

(87) PCT Pub. No.: WO2010/129274

PCT Pub. Date: Nov. 11, 2010

(65) Prior Publication Data

US 2012/0034067 A1 Feb. 9, 2012

Related U.S. Application Data

(60) Provisional application No. 61/173,402, filed on Apr. 28, 2009.

(51) Int. Cl.

| | |
|---|---|
| ***F02B 39/14*** | (2006.01) |
| ***F02B 39/10*** | (2006.01) |
| ***F04D 25/04*** | (2006.01) |
| ***F04D 29/063*** | (2006.01) |

(52) U.S. Cl.

CPC ..... *F02B 39/14* (2013.01); *F02B 39/10* (2013.01); *F04D 25/04* (2013.01); *F04D 29/063* (2013.01)

(58) Field of Classification Search

CPC ..... F02B 39/14; F02B 39/10; F04D 25/04; F04D 25/0626; F04D 29/06; F04D 29/063; F04D 29/102

USPC ..... 415/104, 107, 110, 111, 170.1, 229; 417/407, 408, 409

See application file for complete search history.

(56) References Cited

U.S. PATENT DOCUMENTS 3,892,499 A * 7/1975 Strub ..... 415/179
4,557,664 A * 12/1985 Tuttle et al. ..... 415/105

(Continued)

FOREIGN PATENT DOCUMENTS

EP 0908629 A1 4/1999
JP 09144691 A 6/1997

OTHER PUBLICATIONS

International Search Report and Written Opinion dated Dec. 31, 2010, in connection with related PCT/US10/32562 filed Apr. 27, 2010.

*Primary Examiner* — Edward Look
*Assistant Examiner* — Danielle M Christensen
(74) *Attorney, Agent, or Firm* — Downs Rachlin Martin PLLC

(57) ABSTRACT

A turbocompressor for use with a process fluid and including an axial expansion turbine for expanding the process fluid and a centrifugal compressor for compressing the process fluid. The turbine and compressor share a common shaft, all of which can be housed by a common housing that encloses sealed spaces. The axial expansion turbine has a rotor located between two main bearings, and the centrifugal compressor includes an impeller mounted to one end of the shaft. In one embodiment, the main bearings are lubricated by a portion of the process fluid so that the only fluid in the sealed spaces is the process fluid. The turbocompressor can be used in a power-cycle system that includes a heat source and, optionally, an electrical generator.

20 Claims, 2 Drawing Sheets

(56) References Cited

U.S. PATENT DOCUMENTS 5,412,977 A * 5/1995 Schmohl et al. ..... 73/46
5,483,791 A 1/1996 Kotwal et al.
6,735,945 B1 5/2004 Hall et al.
2010/0111669 A1* 5/2010 Hays et al. ..... 415/48
2011/0131991 A1* 6/2011 Oh et al. ..... 60/644.1

* cited by examiner

TURBOCOMPRESSOR AND SYSTEM FOR A SUPERCRITICAL-FLUID CYCLE

RELATED APPLICATION DATA

This application claims the benefit of priority of U.S. Provisional Patent Application Ser. No. 61/173,402, filed on Apr. 28, 2009, and titled "High-Power Density Super-Critical Carbon Dioxide Turbo-Compression Cycle," which is incorporated by reference herein in its entirety.

FIELD OF THE INVENTION

The present invention generally relates to the field of turbomachinery. In particular, the present invention is directed to a turbocompressor and system for a supercritical-fluid cycle.

BACKGROUND

Supercritical carbon dioxide ($SCCO_2$) is used in a number of applications because of its special properties as a supercritical fluid and for its non-toxicity. For example, $SCCO_2$ is used to produce micro- and nano-scale particles, as a solvent for dry-cleaning, for enhanced oil recovery, as a foaming agent in polymers and in supercritical fluid extraction processes, such as decaffeinating coffee beans, extracting hops for beer production and extracting essential oils from plants. $SCCO_2$ has also been identified for use in closed gas turbine power cycles, such as the Brayton power cycle, because of its very high thermal efficiency of around 45%. This high efficiency cannot only increase the electrical power produced per unit of fuel by 40% or more, but it can also reduce the cost of a power plant by about 18% relative to a plant utilizing a conventional Rankine steam cycle.

SUMMARY OF THE DISCLOSURE

In one embodiment, a turbocompressor for use with a process fluid. The turbocompressor includes: a pair of main bearings spaced from one another along a central rotational axis; a rotational shaft rotatably supported by the pair of main bearings so as to be rotatable about the central rotational axis, the rotational shaft having a first end and a second end spaced from the first end along the central rotational axis; an axial expansion turbine that includes a rotor located between the pair of rotational bearings, the rotor including radial turbine blades attached to the rotational shaft so as to be rotatable therewith about the central rotational axis, the axial expansion turbine for expanding the process fluid; and a centrifugal compressor that includes an impeller secured to the first end of the rotational shaft so as to be rotatable therewith about the central rotational axis, the centrifugal compressor for compressing the process fluid.

In another embodiment, a system that includes: a working fluid, a heat source for providing heat to the working fluid; and a turbocompressor having a central rotational axis and that includes: a pair of main bearings spaced from one another along the central rotational axis; a rotational shaft rotatably supported by the pair of main bearings so as to be rotatable about the central rotational axis, the rotational shaft having a first end and a second end spaced from the first end along the central rotational axis; an axial expansion turbine that includes a rotor located between the pair of rotational bearings, the rotor including radial turbine blades attached to the rotational shaft so as to be rotatable therewith about the central rotational axis, the axial expansion turbine located downstream of the heat source for expanding the process fluid after the process fluid has been heated by the heat source; and a centrifugal compressor that includes an impeller secured to the first end of the rotational shaft so as to be rotatable therewith about the central rotational axis, the centrifugal compressor located upstream from the heat source for compressing the process fluid before the process fluid is heated by the heat source.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

DETAILED DESCRIPTION

Figure 1:
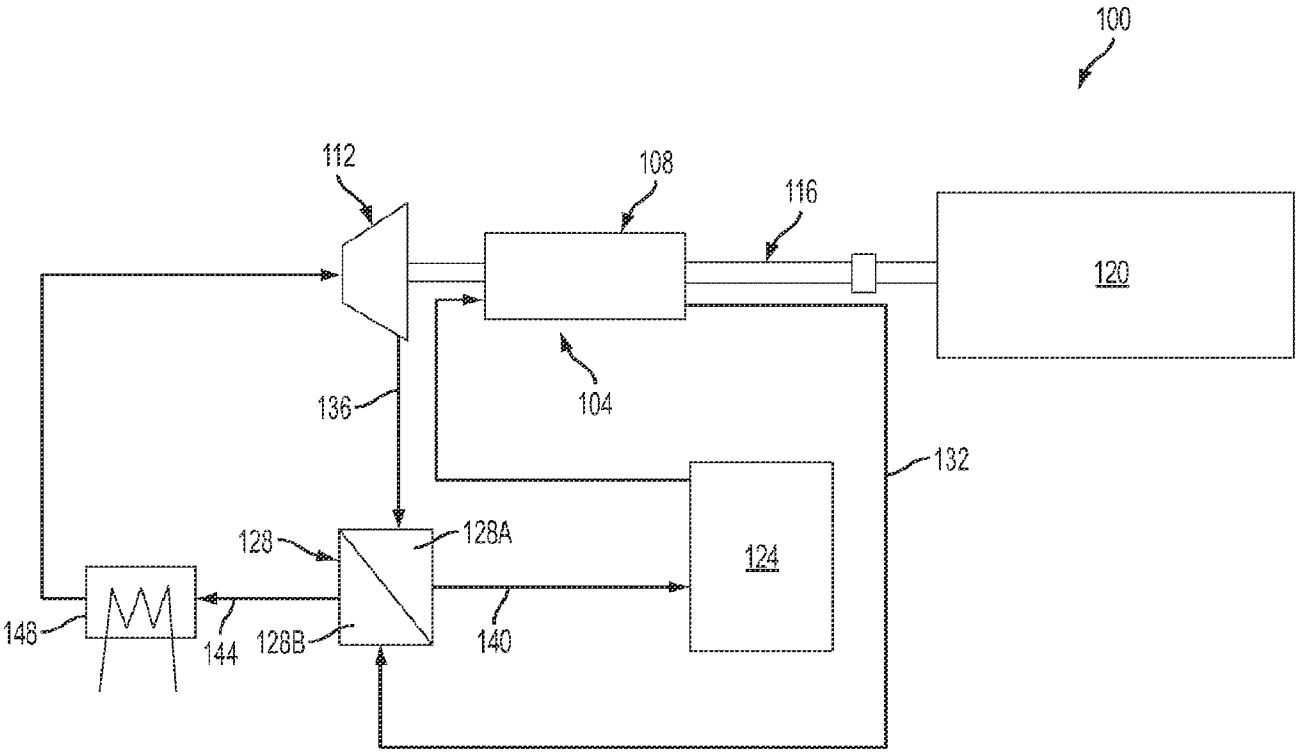
FIG. 1 is a high-level schematic diagram of a Brayton-cycle system of the present disclosure.

Referring now to the drawings, FIG. 1 illustrates a Brayton-cycle closed system 100 that incorporates an embodiment of a unique turbocompressor 104 that is especially suited for use with supercritical fluids, such as supercritical carbon dioxide ($SCCO_2$). As will be described below in more detail, turbocompressor 104 includes an axial turbine 108 and a centrifugal compressor 112 mounted to one end of a common shaft 116. This unique arrangement provides a number of advantages over conventional turbocompressors, advantages that are especially suited to using turbocompressor 104 in a supercritical-fluid-based power cycle, such as the Brayton cycle illustrated with system 100 of FIG. 1. Before describing turbocompressor 104 in more detail, other parts of the exemplary Brayton-cycle system 100 are first described to provide context for this embodiment of the turbocompressor.

In this example, the Brayton cycle is used to generate electrical power via an electrical generator 120 using heat from a heat source 124. As those skilled in the art will readily appreciate, electrical generator 120 can be of any suitable type for converting rotational energy into electrical energy. In many applications, the output of electrical generator 120 would be 5 MW to 1000 MW or more. Heat source 124 may be any suitable heat source for heating the process fluid, for example, $SCCO_2$ in closed system 100 to the desired temperature, for example, 500° C. or higher. As discussed in the paper, V. Dostal, M. J. Driscoll, P Hejzlar, "A Supercritical Carbon Dioxide Cycle for Next Generation Nuclear Reactors," MIT-ANP-TR-100, Mar. 10, 2004, which is incorporated herein by reference for its teachings of power cycles utilizing $SCCO_2$, a nuclear reactor is a prime example of a heat source suitable for use as heat source 124.

In this example, Brayton-cycle system 100 includes a recuperator 128 for recovering heat from the expanded outlet flow 132 from axial turbine 108 to the compressed outlet flow 136 from centrifugal compressor 112 and, correspondingly, remove heat from expanded outlet flow 132. The outlet flow 140 from the high-pressure side 128A of recuperator 128 goes to heat source 124 for further heating prior to being expanded within axial turbine 108. In this example, the outlet flow 144 from the low-pressure side 128B of recuperator 128 goes to a precooler 148 to further remove heat from expanded outlet flow 132 before being compressed by centrifugal compressor 112. Those skilled in the art will understand that system 100 is a very simple example of a power-cycle system and that a turbocompressor made in accordance with the present disclosure, such as turbocompressor 104, can be used in any of a wide variety of $SCCO_2$-based power-cycle systems. Such other systems can include other components, for example, multiple recuperators, one or more condensers, one or more pumps and/or one or more precoolers, among other things. Some specific examples of other power-cycle systems suitable for use with turbocompressor 104 and other turbocompressors made in accordance with the present disclosure can be found in the Dostal et al. paper noted above. It is also noted that while this example is described in the context of $SCCO_2$ as the working fluid, the working fluid may be a fluid other than $SCCO_2$.

Figure 2:
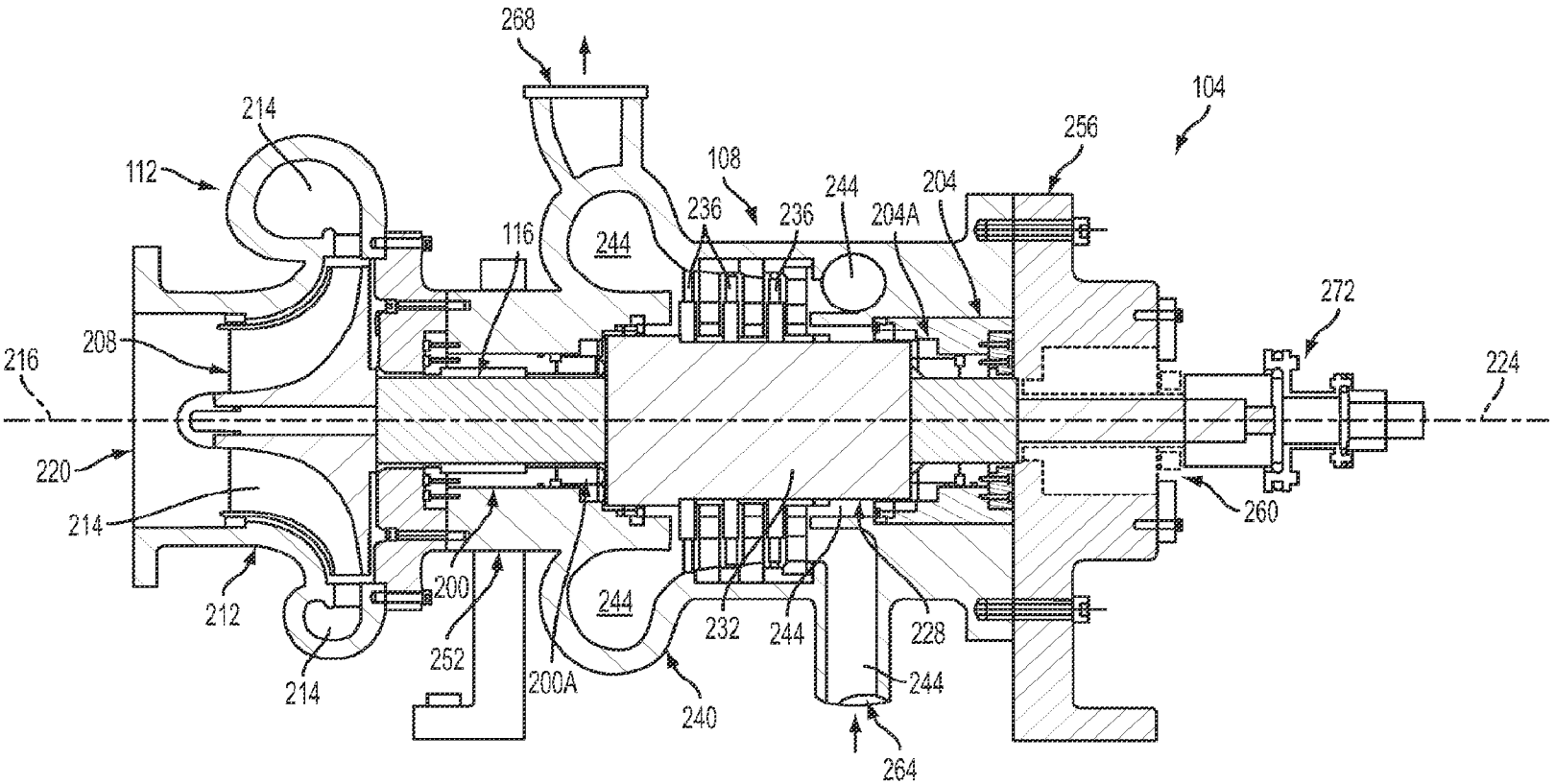
FIG. 2 is a longitudinal cross-sectional view of the turbocompressor of FIG. 1.

FIG. 2 illustrates exemplary turbocompressor 104 of FIG. 1 in more detail. Referring to FIG. 2, in this example common shaft 116 is supported by a pair of main bearing assemblies 200, 204 that rotationally support the shaft. Bearings suitable for use as main bearings 200, 204 can include, for example, any one or more of hydrostatic fluid film from the process flow or a reservoir, hydrodynamic fluid film, hybrid (containing elements of a hydrodynamic and hydrostatic), or a rolling element bearing. Main bearings 200, 204 can include suitable thrust bearings 200A, 204A. Alternatively, thrust bearings 200A, 204A can be provided separately from main bearings, depending on the configuration of common shaft 116. Main bearings 200, 204 and thrust bearings 200A, 204A can have any lubrication system (not shown) suitable for the type(s) of bearings used. As mentioned, in one example, bearings 200, 204 utilize a portion of the process fluid, for example, the $SCCO_2$ when $SCCO_2$ is the process fluid, for lubrication. This has the advantage of avoiding contamination of the process fluid by a different lubricant and/or contamination of the lubricant by the process fluid. Alternatively, a magnetically levitated shaft system may be implemented for main bearings 200, 204 and/or thrust bearings 200A, 204A.

In this example, centrifugal compressor 112 is a single stage compressor having an impeller 208 secured to shaft 116 in any suitable manner, such as being formed integrally with the shaft or formed separately from the shaft and attached thereto using a suitable attachment means (not shown). Examples of attachment means include welding, interference fit, polygon connection, spline connection, Curvic® coupling, friction welding, and shaft stretching, among others. Compressor 112 also includes a housing 212 surrounding impeller 208. Housing 212, in conjunction with impeller 208, and if needed, with other components such as fixed vanes (not shown), define internal process-fluid passageways 214 characteristic of centrifugal compressors. Those skilled in the art will understand how to configure fluid passageways 214 based on the design conditions under consideration, such that no further details need be provided for those skilled in the art to make and use a turbocompressor of the present disclosure.

As seen in FIG. 2, impeller 208 is located outboard of bearings 200, 204. This arrangement has several advantages. For example, by essentially cantilevering impeller 208 from shaft 116, the central axis 216 of inlet 220 to compressor 112 can be coaxial with the rotational axis 224 of the common shaft so as to not be limited in the inlet radii by the shaft. Impeller 208 can have any suitable blade arrangement and can be open, closed or partially shrouded, depending on the particular design selected.

In the embodiment illustrated, axial turbine 108 is a single-stage expansion turbine that includes a rotor 228 having a central disk 232 and a plurality of blades 236 secured to the disk and disposed radially relative to rotational axis 224 of shaft 116. Rotor 228 is located between bearings 200, 204. In this example, rotor 228 has a barrel configuration relative to shaft 116. This barrel configuration acts to stiffen shaft 116 and to provide for Disk 232 can be formed integrally with shaft 116 or, alternatively, formed separately from other parts of the shaft and attached to those other parts in any suitable manner, for example, by interference fit, splining, mechanical fasteners, welding and any combination thereof, among others. Blades 236 can be formed integrally with disk 232 or, alternatively, can be formed separately from the disk and attached thereto in any suitable manner. For example, blades 236 can be attached to disk 232 by welding, fir-tree connection, mechanical fastening, etc. Locating axial turbine 108 between bearings 200, 204 can mimic a traditional steam-power-cycle turbine having interstage diaphragms. It is noted that while axial turbine 108 is shown as being a single-stage turbine, in other embodiments the corresponding axial turbine can be a multistage axial turbine having as many stages as needed to suit a particular design.

Axial turbine 108 also includes a housing 240 that, in combination with rotor 228, and other components, if present, such as fixed vaning (not shown), define internal passageways 244 for containing the process fluid (not shown) during operation. Those skilled in the art will understand how to configure blades 236, fluid passageways 244 and other components of axial turbine 108 based on the design conditions under consideration, such that no further details need to be provided for those skilled in the art to make and use a turbocompressor of the present disclosure. Housing 240 of axial turbine 108 can be formed integrally with other components of turbocompressor 104 that support and enclose main bearings 200 and with housing 212 of compressor 112 to provide a combined housing 252. Housing 212 of compressor 112 can be secured, in a sealing manner, to one or more other parts of combined housing 252 at one end of turbocompressor 104.

In this example, combined housing 252 includes an endpiece 256 located at its end opposite compressor 112. Endpiece 256 is joined to the rest of combined housing 252. A shaft seal 260, such as a dry-gas seal or a zero-leakage mechanical face seal, is provided where common shaft 116 extends through endpiece 256. Importantly, when bearings 200, 204 are lubricated by the process fluid, the entirety of the sealed spaces within turbocompressor 104 between shaft seal 260 and inlet 220 and the outlet (not shown) of compressor 112 and the inlet 264 and the outlet 268 of axial turbine 108 are exposed only to process fluid when turbocompressor 104 is operating. Thus, there are no sources of contamination, such as the lubricant for bearings 200, 204 if the lubricant were not the process fluid, within the sealed spaces of turbocompressor 104. This can be very important to a closed system, such as system 100 of FIG. 1. In this example, common shaft 116 has a flexible coupling 272, such as a Thomas-type coupling, for coupling turbocompressor 104 to generator 120 (FIG. 1) to compensate for any misalignment between the common shaft and the input shaft (not shown) of the generator.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. A turbocompressor for use with a process fluid in a closed thermodynamic cycle, comprising:

a pair of main bearings spaced from one another along a central rotational axis;

a rotational shaft rotatably supported by said pair of main bearings so as to be rotatable about said central rotational axis, said rotational shaft having a first end and a second end spaced from said first end along said central rotational axis;

an axial expansion turbine that includes a rotor located between said pair of main bearings, said rotor including turbine blades coupled to said rotational shaft so as to be rotatable therewith about said central rotational axis, said axial expansion turbine for expanding the process fluid;

a centrifugal compressor that includes an impeller secured to said first end of said rotational shaft so as to be rotatable therewith about said central rotational axis, said centrifugal compressor for compressing the process fluid;

a combined housing that houses said rotor of said axial expansion turbine, said pair of main bearings, and said impeller of said centrifugal compressor; and a seal disposed between said combined housing and said rotational shaft to thereby seal said turbocompressor from atmosphere.

2. A turbocompressor according to claim 1, further comprising a pair of thrust bearings located on opposite sides of said rotor of said axial expansion turbine.

3. A turbocompressor according to claim 2, wherein said common shaft has a first diameter at each of said pair of main bearings and said rotor includes a disk having a second diameter larger than said first diameter, wherein said thrust bearings work against said disk.

4. A turbocompressor according to claim 1, wherein said main bearings are lubricated by a portion of the process fluid.

5. A turbocompressor according to claim 1, wherein said combined housing includes an endpiece located opposite said centrifugal compressor, said endpiece having an opening through which said common shaft extends and said seal being disposed in said opening.

6. A turbocompressor according to claim 5, wherein the only fluid said combined housing contains during normal operation of the turbocompressor is the process fluid.

7. A turbocompressor according to claim 5, wherein said seal is a dry-gas seal.

8. A turbocompressor according to claim 1, wherein a first one of said pair of main bearings is located between said impeller and said rotor such that said impeller is cantilevered from said first main bearing.

9. A turbocompressor according to claim 1, wherein said turbine blades are located approximately midway between said pair of main bearings.

10. A system, comprising:

a working fluid;

a heat source for providing heat to said working fluid; and a turbocompressor having a central rotational axis and that includes:

a pair of main bearings spaced from one another along said central rotational axis;

a rotational shaft rotatably supported by said pair of main bearings so as to be rotatable about said central rotational axis, said rotational shaft having a first end and a second end spaced from said first end along said central rotational axis;

an axial expansion turbine that includes a rotor located between said pair of main bearings, said rotor including turbine blades coupled to said rotational shaft so as to be rotatable therewith about said central rotational axis, said axial expansion turbine located downstream of said heat source for expanding said process fluid after said process fluid has been heated by said heat source; and a centrifugal compressor that includes an impeller secured to said first end of said rotational shaft so as to be rotatable therewith about said central rotational axis, said centrifugal compressor located upstream from said heat source for compressing said process fluid before said process fluid is heated by said heat source, wherein a first one of said pair of main bearings is located between said impeller and said rotor such that said impeller is cantilevered from said first main bearing.

11. A system according to claim 10, further comprising a pair of thrust bearings located on opposite sides of said rotor of said axial expansion turbine.

12. A system according to claim 11, further comprising a combined housing that houses said rotor of said axial expansion turbine, said pair of main bearings, said pair of thrust bearings, and said impeller of said centrifugal compressor so as to thereby seal said axial expansion turbine and said centrifugal compressor from atmosphere.

13. A system according to claim 12, wherein said main bearings are lubricated by a portion of the process fluid.

14. A system according to claim 13, wherein said combined housing includes an endpiece located opposite said centrifugal compressor, said endpiece having an opening through which said common shaft extends, said combined housing further including a seal at said opening for sealing said combined housing from atmosphere.

15. A system according to claim 14, wherein said working fluid comprises supercritical carbon dioxide.

16. A system according to claim 15, wherein said heat source includes a nuclear reactor.

17. A system according to claim 14, wherein said seal is a dry-gas seal.

18. A system according to claim 11, wherein said common shaft has a first diameter at each of said pair of main bearings and said rotor includes a disk having a second diameter larger than said first diameter, wherein said thrust bearings work against said disk.

19. A system according to claim 10, wherein said working fluid comprises supercritical carbon dioxide.

20. A system according to claim 19, wherein said heat source includes a nuclear reactor.

* * * * *